US005417086A

United States Patent [19]

Plath

[11] Patent Number: 5,417,086

[45] Date of Patent: May 23, 1995

[54] LOCK ARRANGEMENT FOR A KNITTING MACHINE

[75] Inventor: Ernst-Dieter Plath, Albstadt, Germany

[73] Assignee: SIPRA Patententwicklungs- und Beteiligungsgesellschaft mbH, Albstadt, Germany

[21] Appl. No.: 155,458

[22] Filed: Nov. 19, 1993

[30] Foreign Application Priority Data

Nov. 28, 1992 [DE] Germany ..... 42 40 037.6

[51] Int. Cl.[6] ..... D04B 15/32

[52] U.S. Cl. ..... 66/57; 66/25; 66/38; 66/78

[58] Field of Search ..... 66/25, 38, 57, 215, 66/216

[56] References Cited

U.S. PATENT DOCUMENTS

| | | | |
|---|---|---|---|
| 3,387,466 | 6/1968 | Beckenstein | 66/38 |
| 3,405,542 | 10/1968 | Beckenstein | 66/38 |
| 3,780,539 | 12/1973 | Mishcon | 66/57 X |
| 3,795,119 | 3/1974 | Bourgeois | 66/57 X |
| 3,967,468 | 7/1976 | Christopoulos | 66/38 X |
| 5,174,131 | 12/1992 | Cottenceau et al. | 66/25 |

FOREIGN PATENT DOCUMENTS

| | | | |
|---|---|---|---|
| 1132678 | 7/1962 | Germany | 66/38 |
| 2053856 | 7/1971 | Germany . | |
| 1585234 | 8/1972 | Germany . | |
| 2608181 | 9/1976 | Germany . | |
| 2366022 | 9/1977 | Germany . | |
| 2636020 | 3/1980 | Germany . | |
| 3733811 | 4/1989 | Germany . | |
| 1541414 | 2/1975 | United Kingdom . | |
| 2204600 | 11/1988 | United Kingdom . | |

*Primary Examiner*—John J. Calvert
*Attorney, Agent, or Firm*—Michael J. Striker

[57] ABSTRACT

A lock arrangement for a knitting machine, which comprises knitting implements (3, 3a) mounted to slide in a longitudinal direction (w), with working and control butts (6, 6a; 7, 7a). The lock arrangement (8) includes a take-down lock part (61) associated with the control butts (7, 7a), slidable in the longitudinal direction (w) and each adjustable into an advanced and a retracted position, these lock parts being provided with raising cams (43, 46) running obliquely to the longitudinal direction (w), arranged one after the other and raising the knitting implements (3, 3a) into a tuck position or a knit position, as well as with hold-down cams (42, 45) running transverse to the longitudinal direction (w). In accordance with the invention the slidable lock parts (10, 10a; 11, 11a) are so constructed and arranged that selected raising cams act in their retracted position on the control butts (7, 7a) and selected hold-down cams (42, 45) act in their advanced position on the control butts (7, 7a). (FIG. 8).

24 Claims, 6 Drawing Sheets

LOCK ARRANGEMENT FOR A KNITTING MACHINE

This invention relates to a lock arrangement for a knitting machine having a bed and knitting implements which are mounted to slide in a longitudinal direction in the bed and have working and control butts spaced in the longitudinal direction, comprising: a take-down lock part associated with the working butts and retracting raised knitting implements and two slidable lock parts being associated with the control butts, slidable in the longitudinal direction and each adjustable into an advanced and a retracted position, said slidable lock parts being provided with hold-down cams running transverse to the longitudinal direction and with raising cams running obliquely to the longitudinal direction and arranged one after the other for raising the knitting implements into a tuck or a knitting position.

Knitting machines, especially large circular knitting machines frequently require lock arrangements with lock parts which are fixedly adjusted for the duration of manufacture of one selected knitwear but which can rapidly be adjusted to another pattern, especially a knitting structure pattern when required. To this end it is known (DE 3 733 811 A1) to provide lock parts which can easily be changed over from the outside when the knitting machine is not in operation, without dismantling the individual lock segments. It is further known to mount support bodies provided with lock parts rotatably in a segment, in order to adjust the lock part selectively into a tuck or a knitting position, by turning the support body from outside (DE-PS 1 585 234), or to provide pivoting switches controllable from outside the lock arrangement (DE-OS 2 366 022). Furthermore it is known above all in circular hose knitting machines (DE-AS 2 053 856) to provide switchable lock parts which can be slid forward or back perpendicular to the longitudinal or sliding direction of the knitting implements, in order to bring them selectively into engagement or not with butts of the knitting implements. Finally, a lock arrangement of the kind defined above is known (DE-OS 2 608 181) in which lock parts slidable in the longitudinal direction of the knitting implements and adjustable from outside in a dial arrangement serve to guide dial needles selectively into a through path or to raise them into a tuck or knit path.

As well as described selection possibilities means, known per se should be present, above all in rapidly running circular knitting machines, which make possible continuous, positive guiding of the knitting implements along their various paths. Such means are not provided in the lock arrangements of the kind initially defined, preferred for various reasons, and are even not capable of being directly realised. It is moreover also already known in such lock arrangements so to guide selected butts of the knitting implements positively that continuously closed lock paths are provided (DE-PS 2 636 020) but this has only previously been possible with renunciation of the desired multiple pattern facility, since e.g. in the transition from knit/miss patterns to knit/tuck patterns or the like, lock parts have to be exchanged, which is troublesome, time-consuming and therefore undesirable. In addition it is known in knitting machines with knitting implements individually selectable according to the pattern to provide these with a plurality of butts, of which at least one is pivoted, and so to form the lock part that the knitting implements are always guided positively by abutment of lock parts on selected burrs, regardless of whether they are guided along a through, tuck or knit path. Transfer of this principle to lock arrangements of the kind initially defined has hitherto been neither provided nor possible.

It is, therefore, an object of this invention to design the lock arrangement as defined above in such a manner that the knitting implements can be guided in a positive manner over practically the whole system width.

A further object is to positively guide the knitting implements over practically the whole system width independent of the adjustment of the slidable lock parts.

Yet another object of this invention is to give the possibility of guiding the knitting implements positively over practically the whole system width in a comparatively simple manner.

These and other objects are achieved with the lock arrangement as defined above by constructing and arranging the slidable lock parts so that selected raising cams act in their retracted position on the control butts whereas selected hold-down cams act on the control butts in their advanced position.

The invention will now be explained in more detail in relation to an embodiment, in conjunction with the accompanying drawings, in which:

FIG. 1 ist a vertical section through a circular knitting machine with a lock arrangement according to the invention;

Figure 1:
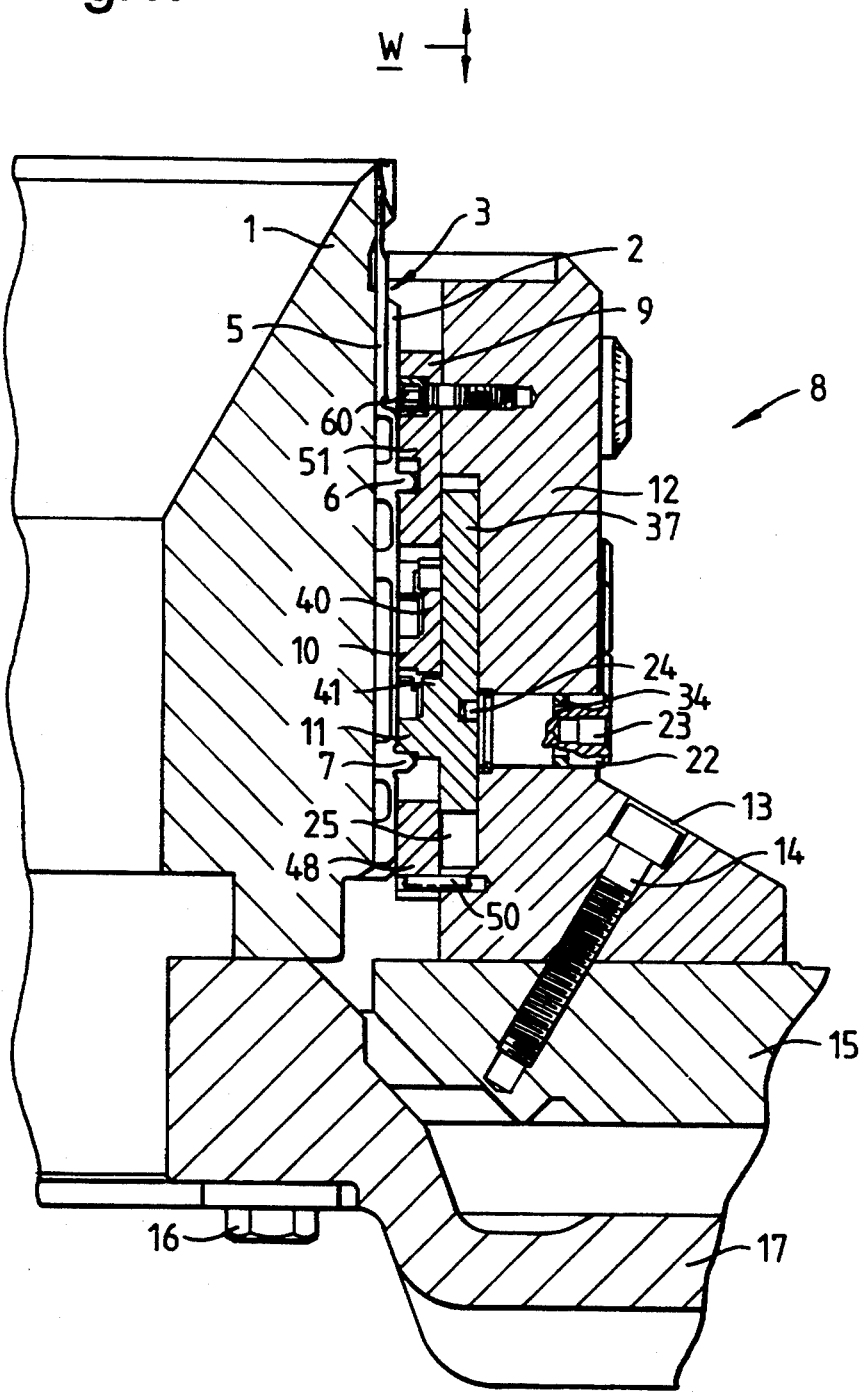

FIG. 1 shows the details of a circular knitting machine needed for an understanding of the invention, namely a bed 1 in the form of a needle cylinder with vertically extending webs 2, between which knitting implements 3, here knitting needles in the form of conventional latch needles, are slidably mounted, each having a shank 5. On this there are formed two outwardly projecting butts, here an upper working butt 6 and a lower control butt 7. A lock arrangement 8 serves for control, with lock parts 9, 10 und 11 which are fixed to a segment 12 and are slidably mounted as required and act in a selected manner on the butts 6, 7 of the knitting implements 3 and are described in more detail below in conjunction with FIGS. 8 to 10. A second bed in the form of a dial, a sinker ring or the like can be associated with the bed 1, in which second bed further knitting implements are slidably mounted and are controlled by a lock arrangement corresponding to the lock arrangement 8. Moreover the bed 1 and the lock arrangement 8 can be moved relative to one another in conventional manner, in order thereby to raise and lower the knitting implements 3 parallel to their longitudinal direction depending on the installed lock parts, or to hold them in a circulating, through or miss position.

Knitting machines and knitting implements of the kind described as well as their selection and control are basically known to the man skilled in the art (DE-OS 2 608 181 or DE 4 007 253 A1) and therefore do not need to be explained in more detail here. The sample applies to the yarn feed into the tuck or knit position of the knitting implements and so no yarn guides, yarn eyes or the like are shown in the drawings.

An embodiment of this invention which is deemed the best one so far, will now be described with particular reference to FIGS. 2 to 10.

By a segment is here understood a support body or the like with bores 13 (FIG. 1), which is fixed to a lock plate 15 by means of screws 14 passing through the bores. The bed 1 is fixed to a support ring 17 by means of screws 16, the support ring being rotatably mounted in a manner not shown in detail in a frame of the circular knitting machine and coupled to a drive motor. The width of a segment 12 and the lock parts fixed thereon preferably corresponds to the width of one knitting system measured in the circumferential direction of the bed 1.

Figure 2:
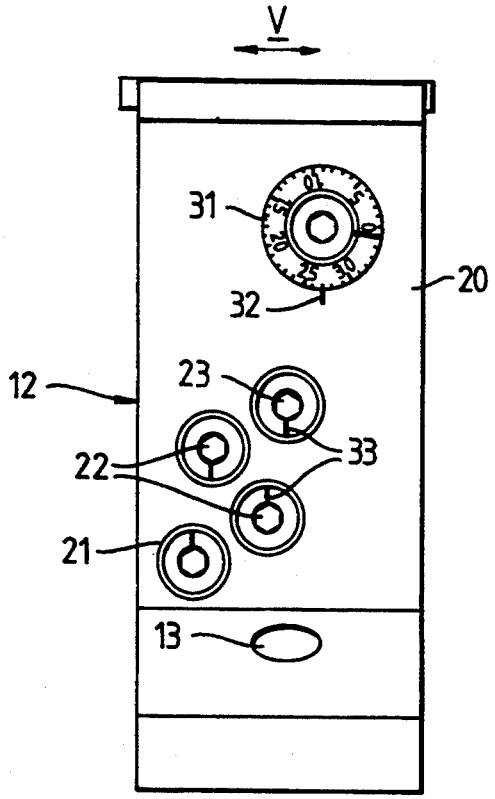
FIGS. 2 and 3 show rear and front views respectively of a segment of the lock arrangement according to the invention.
Figure 3:
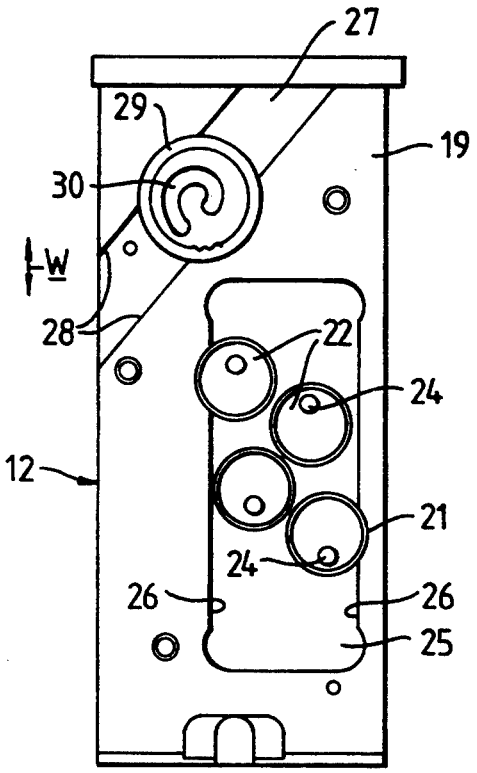

The segment 12 shown in FIGS. 2 and 3 extends over the width of a single knitting system measured in the transverse direction (arrow v), while it is high enough in a longitudinal direction (arrow w) perpendicular thereto to be able to accommodate all of the lock parts needed for control of the knitting implements 3. The knitting implements 3 can also move up and down in the longitudinal direction (arrow w) in the tricks formed between the webs 2 (FIG. 1), this movement of the knitting implements 3 taking place in the longitudinal direction in known manner superimposed on a movement taking place in the transverse direction (arrow v) when the bed 1 is e.g. a needle cylinder rotatable relative to the lock arrangement 8.

According to FIGS. 2 and 3 the segments 12 each comprise a substantially flat front side 19 and a rear side 20 substantially parallel thereto or running along a cylindrical surface, as well as top, bottom and side surfaces not referenced in detail, the basic shape being substantially prismatic overall. Four cylindrical through bores 21 are formed in the segments 12 with their axes perpendicular both to the transverse direction and to the longitudinal direction and thus perpendicular to the front side 19, ending at the rear side 20 of the segment 12. Cylindrical shift pins 22 are rotatably mounted in these bores 21 and have on their rear end means 23 such as hexagonal recesses for application of tool, e.g. an Allen key. As especially shown in FIG. 1, the shift pins have eccentric studs 24 provided on their front ends faces, arranged parallel to their axial direction but eccentric relative to their axes and projecting in the assembled state beyond the front side 19 of the segment 12.

The segment 12 further comprises a recess 25 in its front side with a rectangular cross-section, provided with parallel side surfaces acting as guide surfaces 26 and having a bottom in which the front parts of the bores 21 end. In accordance with FIG. 3 the outline of the recess 25 is so selected that it encloses at least all four of the eccentric studs 24. The depth of the recess 25 measured from the front side corresponds to only a part of the distance of the rear side 20 from the front side 19, i.e. only to part of the thickness of the segment 12.

Above the recess 25 the segment 12 also has a guide groove 27 extending over part only of its thickness and which is bounded by lateral guide surfaces 28 running obliquely relative to the longitudinal direction (arrow w). The bottom of the guide groove 27 is penetrated in a middle part by a cylindrical bore passing through the segment 12 and in which is fitted a cylindrical adjusting pin 29 having a spiral groove 30 in its end face terminating at about the level of the bottom of the guide groove 27. The adjusting pin 29 has a scale 31 on its rear end, cooperating with a mark 32 applied to the rear side 20. In a similar manner the shift pins 22 have marks 33 on their rear ends from which their current rotational position can be ascertained. If these marks 33 are applied according to FIGS. 2 and 3 each where the eccentric stud 24 is located on the front end, the position of the marks 33 provides an indication visible from the outside as to the current position of the eccentric studs 24 and thus, as explained further below, also for the currently set function of the segment in question. In order to avoid too ready a rotation of the adjusting pin 29 and the shift pins 22, these can be provided with peripheral grooves in which are fitted braking rings of rubber or the like, as is indicated in FIG. 1 for one braking ting 34.

The recess 25 (FIG. 3) of the segment 12 serves to receive elongated guide bars 36 and 37 (FIG. 4–7) with their axes parallel to the longitudinal direction, on which the lock parts 10 or 11 are fixed by screws, welding or the like, where the guide bars 36, 37 and the lock parts 10, 11 and parts still to be described can also be made in one piece.

The guide bars 36, 37 have respective end sections 38 and 39 at their ends, with a width corresponding to approximately a quarter of the spacing between the guide surfaces 26 of the recess 25, so that four guide bars 36, 37 can be arranged between these guide surfaces 26. In between the end sections 38, 39 the guide bars 36, 37 are narrower in order to avoid excessive frictional resistance. The depth of the guide bars 36, 37 is so selected, as is apparent in particular from FIG. 1, that their front sides lie just flush with the front side 19 of the segment 12 when they are fitted with their rear sides on the bottom of the recess 25.

The lock parts 10, 11 are fixed to the guide bars 36, 37 by spacers 40 (FIGS. 4, 5) or 41 (FIGS. 6, 7) respectively which have a somewhat greater width than the bars.

While the lock part 10 is comparatively narrow in the transverse direction, the lock part 11 has a width in the transverse direction which corresponds substantially to the width of the segment 12. The trader side of the lock part 11 running substantially parallel to the transverse direction is formed throughout as a hold-down cam 42 for the control butts 7 (FIG. 1). Moreover the lock part 11 has a raising cam 43 for the control butts 7 running obliquely to the longitudinal direction and which extends approximately into the tuck position. A recess 44 is provided at the end of this raising cam 43, the meaning of which is explained below.

The trader side of the lock part 10 running substantially parallel to the transverse direction is formed throughout as a hold-down cam 45 for the control butts 7. Moreover the lock part 10 has a raising cam 46 for the control butts 7 running obliquely relative to the longitudinal direction, whose height difference corresponds approximately to the height difference between the tuck position and the knit position of the knitting implements 3.

Figure 8:
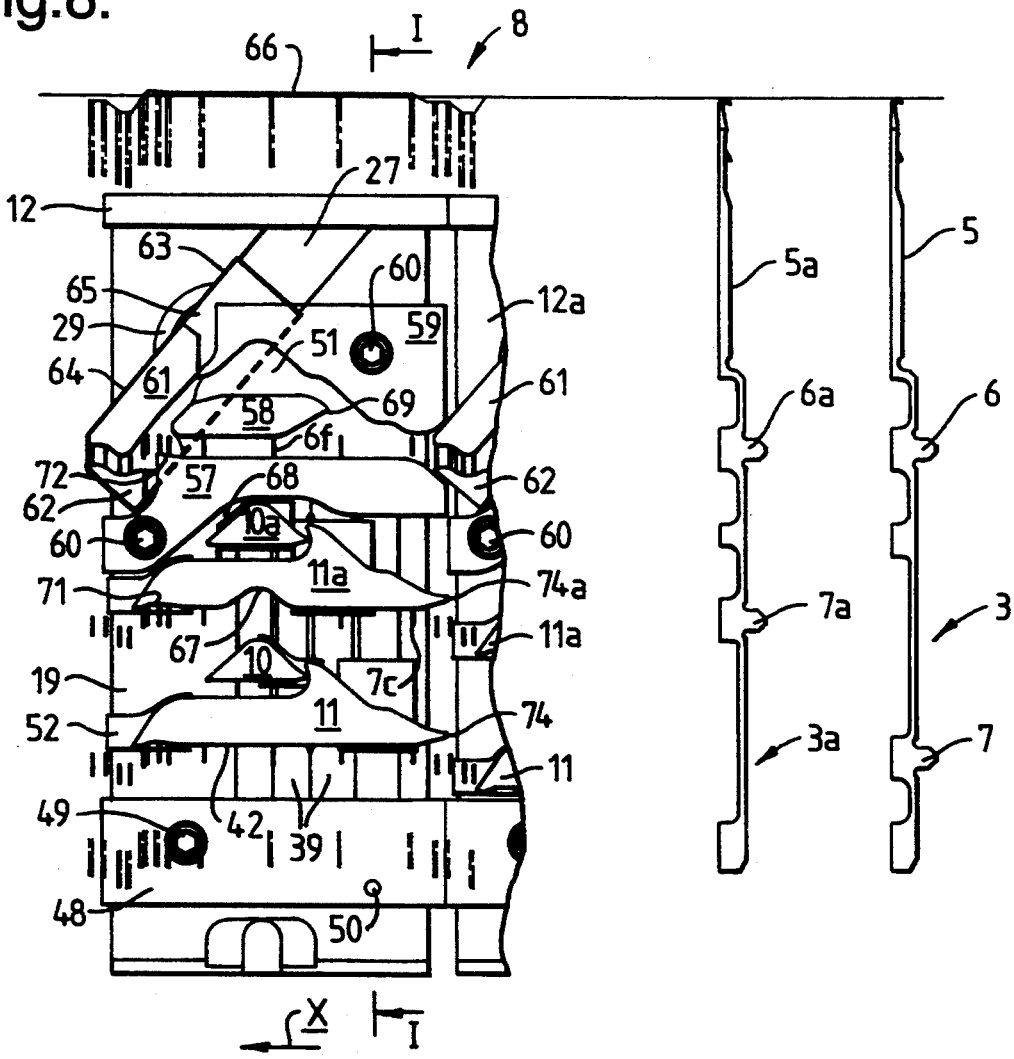
FIGS. 8, 9 and 10 are front views of three segments of the lock arrangement according to the invention provided completely with lock parts.
Figure 9:
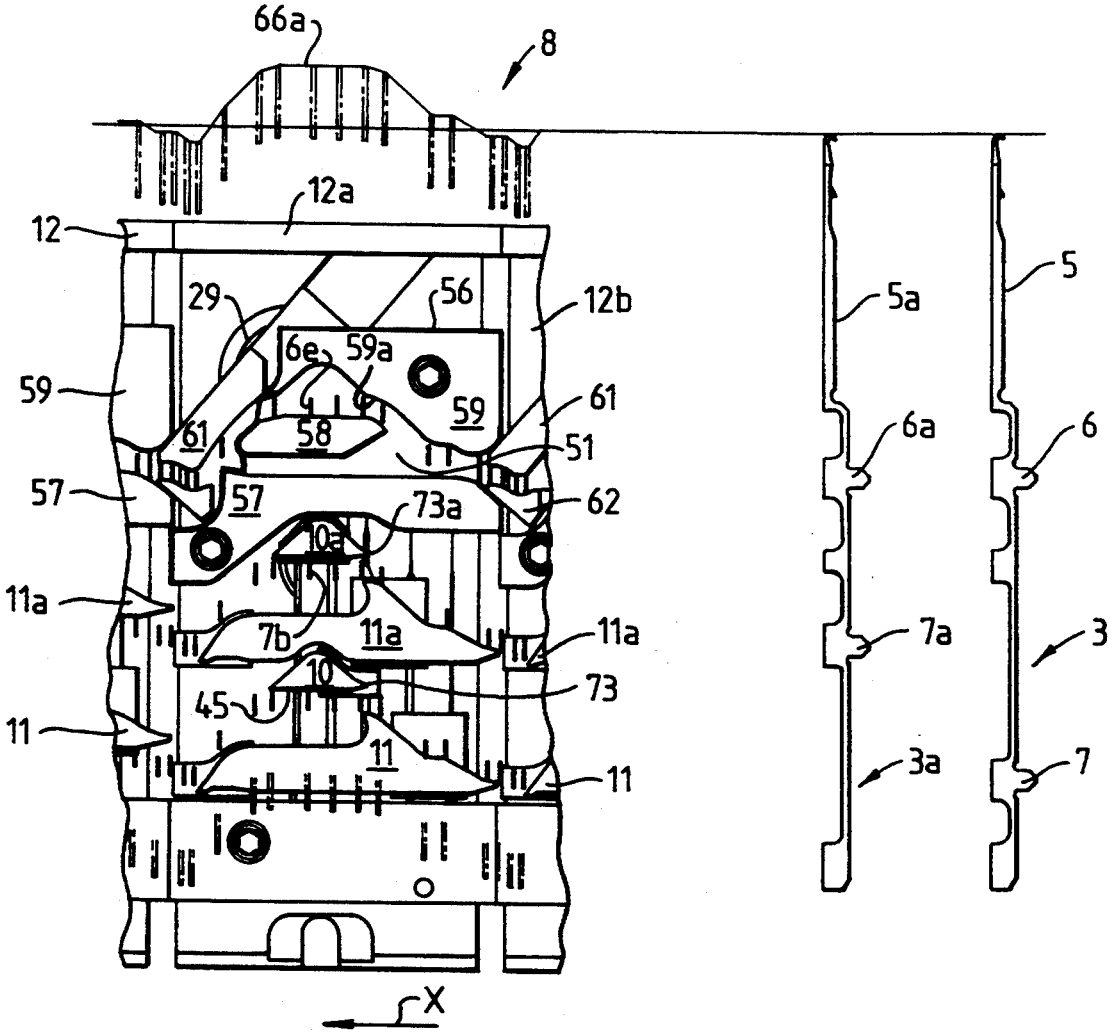
Figure 10:
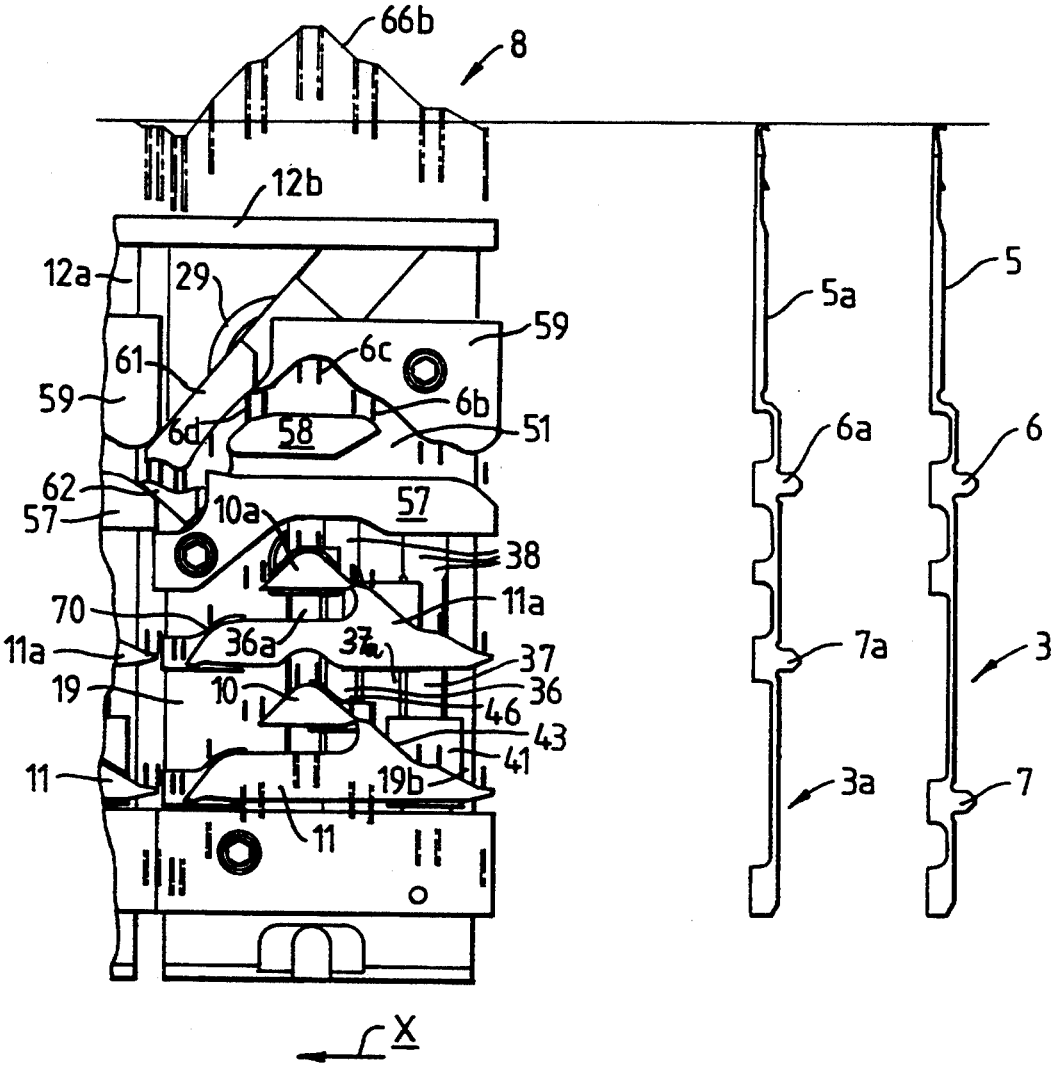

FIGS. 8 to 10 show plan views of three knitting systems or three segments 12, **12*a* and 12*b*** of the lock arrangement according to the invention, where two knitting implements 3 and 3*a* formed as latch needles are shown at the right, differing from one another only in that the control butt 7*a* of the knitting implement 3*a* lies at a higher level than that of the knitting implement 3. In relation to the three adjacently arranged segments 12, 12*a* and 12*b* the section shown in FIG. 1 is to be thought of as approximately along the section line I—I in FIG. 8. Moreover the lock parts of the preceding or following segments are shown partially to the left and-/or fight of the segments in FIGS. 8 to 10.

According to FIG. 8 to 10, four guide bars are arranged alongside each other in each recess 25 of the segments 12, 12*a* and 12*b*, namely from right to left the guide bar 37, a guide bar 37*a*, the guide bar 36 and a guide bar 36*a*, the reference numbers 37, 37*a*: 36 and 36*a* being only shown in FIG. 10. The associated lock parts 10, 10*a*, 11 and 11*a* are so fitted to the guide bars 36, 36*a*, 37, 37*a* that the lock parts 10 and 11 are in the region of the lower control butts 7 while at the same time the lock parts 10*a*, 11*a* are arranged in the region of the upper control butts 7*a*. Moreover the lock part 10 is so arranged that it lies opposite the recess 44 (FIG. 7) of the lock part 11. The same arrangement applies to the lock parts 10*a*, 11*a*. The guide bars 36, 36*a* or 37, 37*a* are shaped substantially identically but the lock parts 10, 11 are fitted in a lower region whereas the lock parts 10*a*, 11*a* are fitted in an upper region and moreover the position of the guide bars 36*a*, 37*a* in the recess 25 is correspondingly selected.

Various measures are taken in order to secure the position and sliding of the guide bars 36, 36*a*, 37 and 37*a* as free from tilting as possible and with small friction against each other and in the recess 25. In the first place a cover part 48 is provided to span the lower end of the recess 25, being fixed on the front side of each segment 12 by means of a screw 49 and a dowel pin 50 (cf. also FIG. 1) and bearing on the lower end sections 39 of the guide bars 36, 36*a*, 37, 37*a*. In addition a second cover part 51 is associated with the upper end sections 38 of the guide bars. Furthermore the parts of the spacers 40, 41 projecting laterally beyond the guide bars can serve the purpose of bearing on the guide bars of other lock parts or on the front side 19 of the segment 12, in order thereby to avoid tilting. This is clearly visible in FIG. 10 for the spacer 41 of the segment 12*b*, which lies on one side on the adjoining guide bar 37*a* and on the other side on the front side 19*b* of the segment 12*b*. Finally the relatively wide lock parts 11, 11*a* have additional slide pieces 52 if required on the ends lying opposite the spacers 41, in accordance with FIGS. 7 and 8, with their height corresponding substantially to the height of the spacers 40, 41 and likewise bearing on the front sides 19 of the segments 12, as is shown in FIG. 8 especially on the left for the segment 12.

By means of the described features it is possible even with maintenance of comparatively wide tolerances to ensure on the one hand a reliable, easy running guiding for the guide bars 36, 36*a*; 37, 37*a* and on the other hand a tilt-free positioning of the lock parts 10, 11, 10*a* and 11*a*, even with the loads arising in operation of the knitting machine, and independent of the position into which the lock parts 10, 11, 10*a*, 11*a* are adjusted in the particular case. Moreover only very small adjustment paths are necessary for the lock parts, so that small structural lengths for the lock arrangement and the knitting implement carrier are possible.

Figure 4:
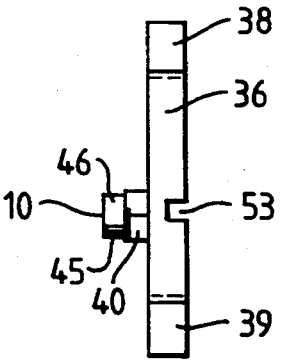
FIGS. 4 and 5 show a side view and a front view respectively of a first slidable lock part of the lock arrangement according to the invention.
Figure 6:
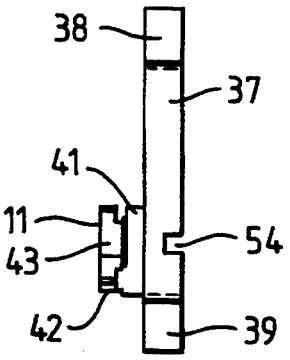
FIGS. 6 and 7 show a side view and a front view respectively of a second slidable lock part of the lock arrangement according to the invention.
Figure 7:
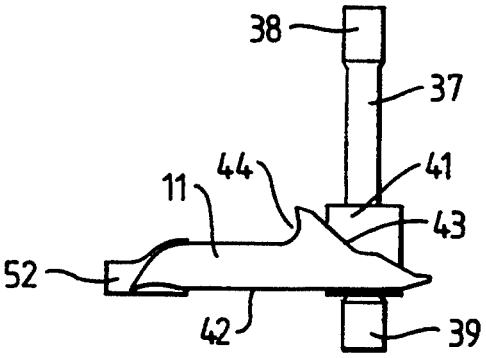

In order to move the lock parts 10, 11 parallel to the longitudinal direction or in the longitudinal direction, the guide bars 36, 36*a*, 37, 37*a* are provided on their rear sides with transverse control grooves 53, 54 (FIGS. 4 and 6). These are placed in such a position that they each receive the eccentric stud 24 of an associated shift pin 22 (FIG. 3) after mounting the guide bars in the recess 25 of the segment 12. If then the associated shift pin 22 is turned from the outside in one direction or the other, this automatically shifts the guide bars 36, 37 and with them the lock parts 10, 11 in the longitudinal direction (arrow w). The arrangement for the guide bars 36*a* and 37*a* corresponds, so that each of the switch pins 22 is associated with one of the four guide bars arranged in a recess 25. This arrangement is advantageously the same for all segments 12, 12*a*, 12*b*, etc.

The upper cover part 51 has an outer contour which is indicated in FIG. 9 for the segment 12*a* by a heavy line. Within this contour there are arranged a boundary lock part 57, a separating lock part 58 and a guide lock part 59. These lock parts act on the working butts 6, 6*a* and project in correspondence with their height in front of the associated cover part 51. The cover parts 51 are fixed to the front side 19 of the segment 12 by means of screws 60 and are preferably in one piece with the lock parts 57, 58 and 59.

Finally the lock arrangement according to the invention comprises a take-down lock part 61 and a complementary lock part 62. These are mounted on a slide piece 63, whose outer contour is indicated in FIG. 8 for the segment 12 by a heavy and partially broken line 64, and are preferably in one piece with the slide piece. The slide piece 63 is so fitted in the guide groove 27 of the segment 12 that a guide pin fitted to its underside comes into engagement in the spiral groove 30 (FIG. 3). The slide piece 63, from which the lock parts 61, 62 stand out with the height of the other lock parts, is so recessed into the guide groove 27 that a section 65 free from lock parts is covered by the cover part 51 and the slide piece 63 is thereby held in the guide groove 27. By turning the adjusting pin 29 only partially visible in FIG. 8, the slide piece 63 can be moved to and fro in the guide groove 27 and the loop size thus be set.

For the sake of simplicity the arrangement of the slidable lock parts 10, 11, 10*a* and 11*a* is so chosen in FIGS. 8 to 10 that all knitting implements 3, 3*a* are guided in the segment 12 (FIG. 8) in a circulating welt or miss path 66, in the segment 12*a* (FIG. 9) in a tuck path 66*a* and-in the segment 12*b* (FIG. 10) in a knit path 66*b*. The paths 66, 66*a* and 66*b* shown in FIGS. 8 to 10 are described by the upper ends of the knitting implements 3 and 3*a*, i.e. by the hooks for example of latch needles, with the butts 6, 6*a* and 7, 7*a* following corresponding paths.

Figure 5:
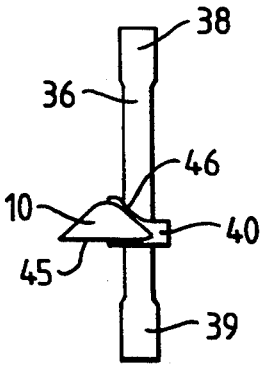

The lock arrangement 8 according to the invention facilitates very simple control of the knitting implements 3 and 3*a*, whose butts are indicated in FIGS. 8 to 10 in the region of the lock parts only as short lines, in the following manner:

If all knitting implements 3, 3*a* are selected to knit (segment 12*b*), all slidable lock parts 10, 11, 10*a* and 11*a* are set in their low or retracted position of FIG. 10. This state is obtained by suitable rotation of the shift pins 22 and by checking the associated marks 33 (FIG. 2), which then all assume e.g. their high position, in order thereby to indicate that the knitting implements will be raised by the associated lock parts. In this case the control butts 7, 7*a* run firstly on the raising cams 43 (FIG. 7) of the lock parts 11, 11*a* and then on to the raising cams 46 (FIG. 5) of the lock parts 10, 10*a* in extension of the cams 43. In the tuck setting (segment 12*a* in FIG. 9), the lock parts 11, 11*a* are again in their low position while the lock parts 10, 10*a* are in their advanced or high position and are thus arranged so high above the lock parts 11, 11*a* that the butts 7, 7*a* cannot run on their raising cams 46 (FIG. 5) but come into the region of the hold-down cams 45 (FIG. 5). The marks 33 of the upper switch pins 22 then point down (=the associated knitting implements pass through in the tuck position), while the marks 33 of the upper switch pins 22 remain up. If no knitting implement 3, 3*a* is to be raised (segment 12 in FIG. 8), both lock parts 10, 11 or 10*a*, 11*a* are set into their high or advanced position. In this case the control butts 7, 7*a* all pass into the region of the hold-down cams 42 (FIG. 7) and are prevented from rising by these. At the same time the lock parts 10, 10*a* are arranged in the recesses 44 (FIG. 7) of the lock parts 11, 11*a* and e.g. all marks 33 point down. Alternatively it would also be possible for this miss position to make the recesses 44 so large that the lock parts 10, 10*a* can assume their low or retracted position corresponding to the segment 12*b* in FIG. 10. Moreover the undersides of the lock parts 11*a* and the boundary lock parts 57 advantageously likewise have recesses 67 and 68 respectively (cf. segment 12 in FIG. 8), into which the lock parts 10, 10*a* can enter in their high position, so that overall better conditions can be achieved in relation to the width and stroke of the lock parts 10, 10*a*, 11, 11*a* or their raising cams. It is also possible thereby to make the segments, knitting implements and knitting implement carder comparatively short, which is particularly important with dial locks, reduces the cost and allows a smaller needle weight and thus greater knitting speeds.

In all therefore the slidable lock parts 10, 10*a*, 11, 11*a* are so formed and arranged that selected raising cams (e.g. 43 or 43 and 46) act in their retracted position and selected hold-down cams (e.g. 42 or 45) act in their advanced position on the control butts 7, 7*a*.

The position of the switch pins 22 is so selected that the eccentric studs 24 are not central in one of the control grooves 53, 54 (FIGS. 4, 6) in their high or low position apparent from FIG. 3 but lie at the fight or left end thereof and therefore abut the adjoining guide bars 36, 37 or the wall bounding the recess 25, so that additional detents, end stops or the like are not necessary. Moreover the shift pins 22 are in accordance with FIGS. 2 and 3 advantageously so formed that the eccentric studs 24 assume their highest and lowest positions in FIG. 3 in the advanced and retracted positions respectively of the slidable lock parts 10, 11 and 10*a*, 11*a*. A further substantial advantage is obtained from this in that the reaction forces which are transmitted from the knitting implements 3, 3*a* or their control butts 7, 7*a* or working butts 6, 6*a* to the slidable lock parts cannot exert any turning moments on the eccentric studs 24. If the lock parts 10, 10*a*, 11, 11*a* are in their advanced position and the associated eccentric studs 24 are in the highest position according to FIG. 3, the knitting implements passing through the tuck or miss position tend to raise the lock parts or eccentric studs still further. Conversely, raising the knitting implements 3, 3*a* with the lock parts and eccentric studs 24 in the low position has the result that these are urged into a still lower position and thereby possibly pressed even more strongly against their stops, which is however impossible in the position according to FIG. 3, so that no turning moments arise in either case.

The full miss, tuck and knit paths 66, 66*a* and 66*b* shown in FIGS. 8 to 10 are realised as follows, when the movement of the bed 1 relative to the lock arrangement 8 is in the direction of an arrow x.

As FIG. 10 shows, all lock parts 10, 10*a*, 11, 11*a* are in their low position in a first knitting system (segment 12*b*). Therefore the butts initially run on the raising cams 43 of the lock parts 11, 11*a*, so that the associated knitting implements are raised. Accordingly their working butts 6, 6*a* are raised above a divider tip 69 (FIG. 8) of the separating lock part 58 (e.g. butt 6*b*). The control butts 7, 7*a* then run on the raising cams 46 of the lock parts 10, 10*a* which are now located in direct continuation of the raising cams 43, so that they are raised to the full knit height (e.g. working butt 6*c*), being protected from impact on the divider tips 73, 73*a* (FIG. 9) of the lock parts 10 ,10*a* by the working butts 6, 6*a* already sliding on the separating lock part 58. Then the working butts 6, 6*a* all come into the working range of the take-down part 61 (e.g. working butt 6*d*), through which the knitting implements 3, 3*a* are withdrawn in correspondence with the knitting path 66*b* firstly into the loop-forming position (coulier-point) and are then raised somewhat again to relax the formed loops. The knitting implements 3, 3*a* are thus positively guided during the whole of the phase of movement. During the raising phase this is effected by means of the lower edges of the control butts 7, 7*a* sliding on the lock parts 11, 11*a*, 10, 10*a* and by means of the working butts 6 and 6*a* sliding with their upper edges on the correspondingly shaped lower edge of the guide lock part 59. During the take-down phase the control butts 7, 7*a* are further guided by the lock parts 10, 10*a* and the working butts 6, 6*a* by the guide lock part 59. The upper edges of the working butts 6, 6*a* then reach the region of the take-down lock part 61 and their lower edges reach the region of the upper edge of the separating lock part 58. After this a suitably shaped upper edge 70 of the lock part 11 or 11*a* takes over the guiding of the lower edges of the control butts 7 and 7*a*, before the working butts 6, 6*a* run into the channel formed by the lower edge of the take-down lock part 61 and the upper edge of the complementary lock part 62 and are positively guided therein. The desired maximum take-down depth is set by adjusting the sliding piece 63 in the guide groove 27 by means of the adjusting pin 29.

The movement of the knitting implements 3, 3*a* in the tuck path 66*a* (segment 12*a* in FIG. 9) is realised in a similar manner. However the lock parts 10, 10*a* are here in their high position, so that the control butts 7, 7*a* run on to the lower hold-down cams 45 of the lock parts 10, 10*a* (e.g. butt 7*b*) after passing the lock parts 11, 11*a*, and thereby are prevented from being raised further. This function is moreover rendered secure in that the guide lock part 59 is provided with a cam section 59*a* which acts on the working butts 6, 6*a* and thereby ensures that the control butts 7, 7*a* cannot reach the raising cams of the lock parts 10, 10*a* or strike their divider tips 73, 73*a*, but pass beneath these. Moreover the lower edges of the working butts 6, 6*a* are guided on the upper edge of the separating lock part 58 (e.g. butts 6*e*), so that positive guiding of the knitting implements 3, 3*a* is effected in this region also. Otherwise the movement of the knitting implements 3, 3*a* is analogous to that in the segment 12*b*.

In a third knitting system appearing in FIG. 8 (segment 12), the circulating welt or miss path 66 is realised, all lock parts 10, 10*a*, 11, 11*a* being in their highest position. This has the result that the control butts 7, 7a strike the lower hold-down cams 42 at the entrance to this system (e.g. butt 7c), which cams extend over practically the whole system width and the working butts 6, 6a are guided beneath the divider tip 69 of the separating lock part 58 into a run-through path, in which they simultaneously slide on the upper edge of the boundary lock part 57 (e.g. butt 6f). Accordingly the knitting implements are constantly guided positively by two butts in the circulating path, before they run into the path section formed between the take-down and complementary lock parts 61, 62. The hold-down cams 42 of the lock parts 11, 11a and the upper edges of the boundary lock part 57 can additionally be so shaped, as is indicated by the references 71, 72 in FIG. 8, or be so provided with a bevel, that the working butts 6, 6a guided in the through path also strike the take-down lock part 61 gently, i.e. at a comparatively small, flat angle. Finally FIGS. 8 and 9 in particular show that the control butts 7, 7a also cannot deviate on to the divider tips 74, 74a (FIG. 8) of the lock parts 11a and 11 respectively.: The lock parts 61, 62 are for this each extended into a following system or overlapped therewith, so that they guide the working butts 6, 6a sufficiently long for the control butts 7; 7a to have passed reliably beneath the associated divider tips 73, 74 with the lock parts 11, 11a raised (FIG. 8) and to have passed reliably over the tips with the lock parts 11, 11a lowered (FIG. 9). This applies over the whole range of adjustment of the sliding piece 63, i.e. independently of what mesh length is set in a given case by the take-down lock part 61. This ensures that the knitting implements 3, 3a are always so guided positively and therefore without wandering in all three paths 66, 66a and 66b that their butts 6, 6a and 7, 7a cannot anywhere strike hard on the respective lock part or bounce against separating edges of the lock parts and thereby break.

It will further be understood that the lock representation in FIGS. 8 to 10 is only an example. In particular it is possible to set the lock parts 10, 10a or 11, 11a differently, in that for example the lock parts 10, 11 are moved into the position shown for the segment 12b while the lock parts 10a, 11a on the other hand are moved into the position shown for the segment 12a. Through this a 1:1 tuck/knit structure is created in the segment 12b, if the knitting implements 3, 3a e.g. have control butts 7 and 7a alternately. 1:1 knit/miss or 1:1 tuck/miss structures can correspondingly be created, which can moreover be displaced from segment to segment.

Figure 11:
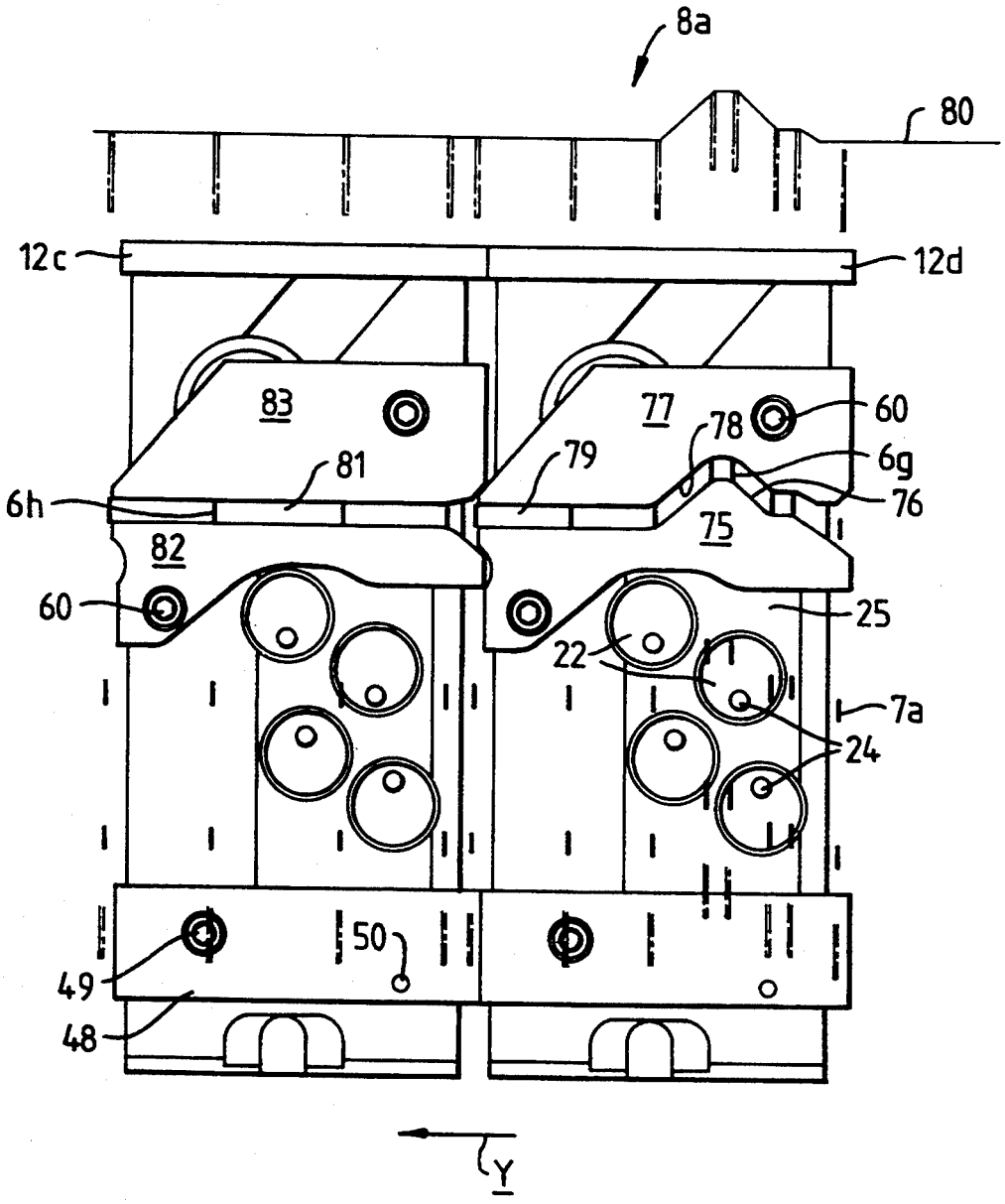
FIG. 11 is a front view of two adjacent segments of the lock arrangement according to the invention only partially provided with lock parts, in use for a special case.

One mode of application of a lock arrangement 8a according to the invention is shown in FIG. 11, with two adjacently arranged segments 12c, 12d, which comprise none of the lock parts illustrated in FIGS. 8 to 10 with the exception of the cover part 48 and therefore also not the guide bars 36, 36a, 37, 37a. Instead thereof the segment 12d has a raising lock part 75 with a raising cam 76 acting on the working butts (e.g. 6g) and extending into the tuck position or even somewhat deeper, and a take-down lock part 77 with a take-down cam 78 immediately following this. Both lock parts 75, 77 are preferably in one piece, which is mounted with the same screws 60 as the cover part 51 (FIG. 8). Moreover, the lock parts 75, 77 preferably form a closed path 79 for the working butts 6, 6a extending over the whole system. The effect of the path 80 corresponding to FIGS. 8 to 10 is that all knitting implements are briefly raised by means of the lock parts 75, 77 and are immediately sunk again, where the take-down takes place so early in comparison with the usual tuck position (e.g. segment 12a in FIG. 9) that the knitting implements or the associated knitting needles receive no yarn and cannot throw off any loops. Segments of this kind serve for example in circular knitting machines with a needle cylinder and a dial to raise the dial needles (or cylinder needles) briefly during the knitting of a tubular knit course by raising only of the cylinder needles (or dial needles) so that they reliably prevent rising of the loops on the latter during the raising.

The segment 12c is according to FIG. 9 provided with a closed path 81 for the working butts (e.g. 6h) running through in the run-through or miss position. The path 81 is formed by two boundary lock parts 82 and 83 extending over the whole segment width, advantageously in one piece which is also fixed by means of the screws 60. Segments of this kind are used when a knitting system is to be completely switched out of action.

In both segments 12c, 12d care is take as in the lock arrangement 8 according to FIG. 8 that the knitting implements are constantly positively guided.

The invention is not limited to the described embodiments, which can be modified in many ways. In particular the described lock arrangements can also be used on flat knitting machines or in combination with circular knitting machines in which the lock arrangement rotates relative to a stationary needle cylinder. It is further possible to provide segments 12 which comprise the lock parts for more than one knitting system and which correspondingly extend over the width of a plurality of systems. It is further possible to provide lock parts or adjusting devices adapted to form the loops or adjust the loop length, other than the combination of take-down lock part 61, complementary lock part 62 and sliding piece 63. It would further be possible to do away with the recess 25 in the segments 12 to 12d and to provide instead a separate receiver plate which has a through recess corresponding to the recess 25. In this case the cover parts 48, 51 (FIG. 8) could be made in one piece with the receiver plate.

It would also be possible to provide a separate recess for each guide bar or two recesses in each of which two guide bars are arranged. Furthermore additional matching strips could be arranged in the recesses as well as the guide bars, serving for example to compensate for large tolerances. Apart from this it would naturally also be possible to arrange the working butts 6, 6a and the lock parts acting thereon below the control butts 7, 7a, in contrast to FIGS. 8 and 9. It would further be possible to arrange the lock parts 10, 11 and 10a, 11a in more than two planes or only in one plane and to provide the knitting implements correspondingly with control but is 7, 7a in more than two-planes or only in a single plane. Finally other means than the illustrated shift pins 22 and eccentric studs 24 could be provided for adjustment of the slidable lock parts and the shift pins be provided with addition traverse studs or the like which prevent inadvertent withdrawal of the shift pins to the rear and hence the eccentric studs dropping out of the control grooves and which bear for example on the bottom of the recesses 25.

In order to switch over the lock parts 10, 10a, 11 and 11a to another pattern either the knitting implements are removed over the width of one segments in order to make it possible to effect the changeover in a space which is free from needles and which is then moved on from segment to segment, or the individual segments are removed from the lock plate, adjusted outside the machine and then fixed to the lock plate again after suitable adjustment of the butts 6, 6*a* and 7, 7*a* by means of a template.

It will be understood that each of the elements described above, or two or more together, may also find a useful application in other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lock arrangement for a knitting machine having a bed (1) and knitting implements (3, 3*a*) slidably mounted in a longitudinal direction (w) in the bed (1) between raised tuck or knitting positions and retracted non-knitting positions and the implements having working and control butts (6, 6*a*; 7, 7*a*) spaced in the longitudinal direction (w), the lock arrangement comprising a take-down lock part (61) positional to act on the working butts (6, 6*a*) so as to move raised knitting implements into a retracted position (3, 3*a*), and slidable lock parts (10, 10*a*; 11, 11*a*) positioned to act on the control butts (7, 7*a*) so as to optionally move the knitting implements (3, 3*a*) into one of said non-knitting, tuck or knitting positions; said slidable lock parts (10, 10*a*; 11, 11*a*) being positionable in the longitudinal direction (w) between advanced and retracted positions and having hold-down cams (42, 45) running transverse the longitudinal direction (w); wherein, when the slidable lock parts are arranged in the retracted position raising cams engage the control butts (7, 7*a*) and when in the advanced position hold-down cams (42, 45) engage the control butts (7, 7*a*).

2. A lock arrangement according to claim 1, characterized in that the arrangement also comprises a separating lock part (58) for separating the working butts (6*b*) of raised knitting implements (3,3*a*) from the working butts (6*b*) of non-raised knitting implements (3,3*a*).

3. A lock arrangement according to claim 2, characterized in that the separating lock part (58) is arranged stationary therein.

4. A lock arrangement according to claim 2, characterized in that the separating lock part (58) has a divider tip (69) and the working butts (6, 6*a*) pass, through action on the control butts (7, 7*a*) of the raising and hold-down cams (43, 42), above the tip with the lock parts (11, 11*a*) retracted and below the tip with the lock parts (11, 11*a*) advanced.

5. A lock arrangement according to claim 2, characterized in that the lock part (10, 10*a*) has a divider tip (73, 73*a*) and the separating lock part (58) and a guide cam (59*a*) of a guide lock part (59) associated with the separating lock part so act on the working butts (6, 6*a*), such that the control butts (7, 7*a*) pass below the divider tip (73, 73*a*) with the lock part (10, 10*a*) advanced and below the divider tip with the lock part (10, 10*a*) retracted.

6. A lock arrangement according to claim 1, characterized in that the working and control butts (6, 6*a* and 7, 7*a*) are rigidly fitted to the knitting implements (3, 3*a*).

7. A lock arrangement according to claim 1, characterized in that the take-down lock part (61) is adjusted to different positions for drawing down raised knitting implements to different extents (3, 3*a*).

8. A lock arrangement according to claim 1, characterized in that said take-down lock part (61) is arranged at an angle and that the hold-down cam (42) of the lock part (11, 11*a*) is provided with a bevel (71) at one end thereof having an angle being flatter than the angle of the take-down lock part (61).

9. A lock arrangement according to claim 1, characterized in that the arrangement provides the knitting implements (3, 3*a*) with positive guidance substantially completely during operation.

10. A lock arrangement according to claim 9, characterized in that the positive guiding is provided by boundary and guide lock parts (57, 59) which act on the working butts (6, 6*a*).

11. A lock arrangement according to claim 10, characterized in that at least a separating lock part (58), the boundary lock part (57) and the guide lock part (59) are provided as one piece.

12. A lock arrangement according to claim 1, characterized in that each knitting implement (3, 3*a*) has one working butt (6, 6*a*) and one control butt (7, 7*a*).

13. A lock arrangement for a knitting machine having a bed (1) and knitting implements (3, 3*a*) slidably mounted in a longitudinal direction (w) in the bed (1) and the implements having working and control butts (6, 6*a*; 7, 7*a*) spaced in the longitudinal direction (w), comprising: a take-down lock part (61) associated with the working butts (6, 6*a*) and positioned for retracting raised knitting implements (3, 3*a*) and two slidable lock parts (10, 10*a*; 11, 11*a*) associated with the control butts (7, 7*a*), said slidable lock parts (10, 10*a*; 11, 11*a*) each being positionable in the longitudinal direction (w) and adjustable into an advanced and a retracted position, said slidable lock parts provided with hold-down cams (42, 45) running transverse to the longitudinal direction (w) and with raising cams (43, 46) running obliquely to the longitudinal direction (w) and arranged one after the other for raising the knitting implements (3, 3*a*) into a tuck or a knitting position, said slidable lock parts (10, 10*a*; 11, 11*a*) further being so constructed and arranged such that selected, retracted, raising cams act on the control butts (7, 7*a*) and selected, advanced, hold-down cams (42, 45) act on the control butts (7, 7*a*), said slidable lock parts (10, 10*a*; 11, 11*a*) being fitted on guide bars (36, 36*a*; 37, 37*a*), the guide bars are arranged alongside each other and slidably mounted in the longitudinal direction (w) in a recess (25) having side walls provided in a segment (12 or 12*d*) in the lock arrangement.

14. A lock arrangement according to claim 13, characterized in that the recess (25) is formed in the surface of the segment (12 to 12*d*).

15. A lock arrangement according to claim 14, characterized in that cover parts (48, 51) are provided and cover the recess (25) at least partially and thereby retain the guide bars (36, 36*a*; 37, 37*a*) in the recess (25).

16. A lock arrangement according to claim 13, characterized in that the recess (25) is formed in a lock plate fixed to the segment.

17. A lock arrangement according to claim 13, characterized in that rear sides of the guide bars (36, 36*a*; 37, 37*a*) have control grooves (53, 54) for the movement of the various lock parts (10, 10*a*; 11, 11*a*).

18. A lock arrangement according to claim 17, characterized in that shift pins (22) pass through the segments (12 to 12*f*) and front ends of the shift pins are provided with eccentric studs (24) projecting into the control grooves (53, 54).

19. A lock arrangement according to claim 18, characterized in that the position of the eccentric stud (24) associated with any one of the slidable lock parts (10, 10*a*, 11, 11*a*) is so formed that, in the advanced and retracted positions of the associated lock part (10, 10*a*; 11, 11*a*), the stud abuts the guide bar (36, 36*a*; 37, 37*a*) of another slidable lock part (10, 10*a*; 11, 11*a*) or one of the sidewalls bounding the recess (25).

20. A lock arrangement according to claim 18, characterized in that the position of the eccentric stud (24) is so formed that the slidable lock part (10, 10*a*; 11, 11*a*) exerts substantially no turning moment thereon when the knitting implements (3, 3*a*) strike the raising or hold-down cams (43, 46; 42, 45).

21. A lock arrangement according to claim 13, characterized in that rear ends of the shift pins (22) are provided with marks (33) indicating positions of the lock part (10, 10*a*; 11, 11*a*).

22. A lock arrangement according to claim 13, characterized in that widened spacers (40, 41) are arranged between the various lock parts (10, 10*a*; 11, 11*a*) and the guide bars (36, 36*a*; 37, 37*a*), the spacers bear on the guide bars (36, 36*a*;37, 37*a*) of adjacent lock parts (10, 10*a*; 11, 11*a*) or the surface of the segment (12 to 12*f*) or of the lock plate.

23. A lock arrangement for a knitting machine having a bed (1) and knitting implements (3, 3*a*) slidably mounted in a longitudinal direction (w) in the bed (1) and the implements having working and control butts (6, 6*a*; 7, 7*a*) spaced in the longitudinal direction (w), comprising: a take-down lock part (61) associated with the working butts (6, 6*a*) and positioned for retracting raised knitting implements (3, 3*a*) and two slidable lock parts (10, 10*a*; 11, 11*a*) associated with the control butts 7, 7*a*), said slidable lock parts (10, 10*a*; 11, 11*a*) each being positionable in the longitudinal direction (w) and adjustable into an advanced and a retracted position, said slidable lock parts provided with hold-down cams (42, 45) running transverse to the longitudinal direction (w) and with raising cams (43, 46) running obliquely to the longitudinal direction (w) and arranged one after the other for raising the knitting implements (3, 3*a*) into a tuck or a knitting position, said slidable lock parts (10, 10*a*; 11, 11*a*) further being so constructed and arranged such that selected, retracted, raising cams act on the control butts (7, 7*a*) and selected, advanced, hold-down cams (42, 45) act on the control butts (7, 7*a*), said lock parts (11, 11*a*) having divider tips (74, 74*a*) and said take-down lock part (61) and an associated, complementary lock part (62) being associated with the working butts (6, 6*a*) and arranged such that the control butts (7, 7*a*) pass below the divider tips (74, 74*a*) with the lock part (11, 11*a*) advanced and above them with the lock part (11, 11*a*) retracted.

24. A lock arrangement according to claim 23, characterized in that ends of the take-down and complementary lock part (61, 62) in adjacent lock arrangements (12, 12*a*, 12*b*) are arranged on a like axis or are overlapped.

* * * * *